US009530279B2

(12) United States Patent
Smith et al.

(10) Patent No.: US 9,530,279 B2
(45) Date of Patent: Dec. 27, 2016

(54) THREE-CARD WAR GAME WITH WAGERS

(76) Inventors: Ray Smith, Linden, NJ (US); Amanda Tears Smith, Linden, NJ (US)

( * ) Notice: Subject to any disclaimer, the term of this patent is extended or adjusted under 35 U.S.C. 154(b) by 0 days.

(21) Appl. No.: 13/272,416

(22) Filed: Oct. 13, 2011

(65) Prior Publication Data

US 2013/0095902 A1 Apr. 18, 2013

(51) Int. Cl.
*G07F 17/32* (2006.01)

(52) U.S. Cl.
CPC ..... *G07F 17/326* (2013.01); *G07F 17/3293* (2013.01)

(58) Field of Classification Search
USPC ..... 463/11; 273/292
See application file for complete search history.

(56) References Cited

U.S. PATENT DOCUMENTS

| | | | | |
|---|---|---|---|---|
| 5,324,041 | A * | 6/1994 | Boylan et al. | 273/292 |
| 5,685,774 | A | 11/1997 | Webb | |
| 6,056,641 | A | 5/2000 | Webb | |
| 6,237,916 | B1 | 5/2001 | Webb | |
| 6,345,823 | B1 | 2/2002 | Webb | |
| 6,585,588 | B2 * | 7/2003 | Hartl | 463/16 |
| 6,698,759 | B2 | 3/2004 | Webb et al. | |
| 7,195,243 | B2 | 3/2007 | Kenny et al. | |
| 7,387,300 | B2 | 6/2008 | Snow | |
| 7,458,583 | B2 * | 12/2008 | Wilson | 273/292 |
| 7,533,886 | B2 | 5/2009 | Kenny et al. | |
| 7,584,966 | B2 | 9/2009 | Snow | |
| 2005/0164759 | A1 | 7/2005 | Smith et al. | |
| 2007/0155462 | A1 * | 7/2007 | O'Halloran et al. | 463/16 |
| 2008/0076520 | A1 * | 3/2008 | Chan et al. | 463/20 |
| 2009/0079133 | A1 * | 3/2009 | Wilson | 273/292 |
| 2010/0016050 | A1 | 1/2010 | Snow et al. | |
| 2010/0062845 | A1 | 3/2010 | Wadds et al. | |
| 2010/0090405 | A1 | 4/2010 | Snow | |

FOREIGN PATENT DOCUMENTS

| | | |
|---|---|---|
| GB | 94/14822 | 7/1994 |
| GB | 94/26324 | 12/1994 |

* cited by examiner

*Primary Examiner* — Jay Liddle
(74) *Attorney, Agent, or Firm* — Mark A. Litman & Associates, P.A.

(57) ABSTRACT

A wagering playing card game is played by:
a dealer providing a set of playing cards;
the dealer accepting at least one wager at a player position on an underlying playing card game;
the dealer providing a first subset of exactly three random playing cards from the set of playing cards to a player position and dealer position;
the dealer evaluates each player hand against the dealer hand as follows:
a) a player position hand having all three cards with a rank below a predetermined rank automatically loses;
b) a highest rank card from each player hand and the dealer hand play a game of war as a first sub-game, with the highest rank winning;
c) a second highest rank card from each player hand and the dealer hand play a game of war as a second sub-game, with the highest rank winning;
d) any ties void a sub-game.

2 Claims, 4 Drawing Sheets

THREE-CARD WAR GAME WITH WAGERS

U.S. Pat. No. 6,698,759 (Webb et al.) claims priority through a long line of patents and applications (this patent is a continuation-in-part of U.S. patent application Ser. No. 09/249,118 filed Feb. 12, 1999 now U.S. Pat. No. 6,345,823 which in turn is a continuation-in-part of U.S. patent application Ser. No. 09/170,092 filed Oct. 13, 1998, now U.S. Pat. No. 6,237,916 issued May 29, 2001, which is a continuation-in-part of U.S. patent application Ser. No. 08/889,919 filed Jul. 10, 1997 now U.S. Pat. No. 6,056,641 issued May 2, 2000, which is a division of U.S. patent application Ser. No. 08/504,023 filed Jul. 19, 1995, now U.S. Pat. No. 5,685,774 issued Nov. 11, 1997, which claims priority under 35 U.S.C. 119 from United Kingdom Patent Applications 94/26324 filed Dec. 29, 1994 and 94/14822 filed Jul. 22, 1994.) for a game known in the industry as the "Three-Card Poker"™ game. U.S. Pat. Nos. 7,387,300 (Snow); 7,584,966 (Snow) 7,195,243 (Kenny); and 7,533,886 (Kenny) describe variants of poker games in which combinations of cards are used to form poker hands of four cards in a competition against a paytable and/or a dealer's hand.

BACKGROUND OF THE INVENTION

1. Field of the Invention

The present invention relates to the field of casino wagering games controlled by a dealer or electronic gaming apparatus and particularly wagering games having "War" options as known in card games.

2. Background of the Art

U.S. Pat. No. 7,458,853 (Wilson) discloses a method of playing a card game based broadly on the game of WAR wherein the higher card wins when a player card in matched against a dealer card. The game includes dealing multiple cards such as 3, 5, 7, etc. to each of the dealer and player for matching against each other. The player must win a majority of the individual card matches to win. In the event of a tie a War Round is declared and three cards are dealt face down to the player and to the dealer, and one card dealt face up to both the player and the dealer. If the dealer wins the War Round by having a greater value up card the game is terminated. If the player wins, bonus points are awarded to the player based upon the value of the face down cards. Greater bonus points are also awarded if the player wins the War Round with an Ace. Another secondary Bonus Round is played if the player wins the War Round with a Joker. The War Round and initial multiple card game are temporarily interrupted, but maintained while the Bonus Round is played. In the Bonus Round the player is awarded additional points by selecting a number of cards from a face down deck of cards. The method preferably is performed as an electronic video game with a touch screen.

SUMMARY OF THE INVENTION

A wagering card game is played by:

a dealer providing a randomized set of playing cards;

the dealer accepting at least one wager at a player position on an underlying playing card game;

the dealer providing a first subset of exactly three playing cards to a player position;

the dealer providing a second subset of exactly three playing cards to a dealer position;

the dealer accepting continuation of the underlying playing card game at each player position having made the at least one wager by accepting an additional raise wager or receiving no raise wager at a player position;

the dealer then reveals all playing cards at the player positions and all cards at the dealer position and the dealer evaluates each player hand against the dealer hand as follows:

a) a player position hand having all three cards with a rank below a predetermined rank automatically loses;

b) a highest rank card from each player hand and the dealer hand play a game of war as a first sub-game, with the highest rank winning;

c) a second highest rank card from each player hand and the dealer hand play a game of war as a second sub-game, with the highest rank winning;

d) any ties void a sub-game;

if the dealer determines that a player position's two sub-games provide more wins against the dealer, the dealer resolves the at least one wager and any additional raise wager in favor of the player position based on the qualification of the dealer's hand;

if the dealer determines that a dealer position's two sub-games provide more wins against the player, the dealer resolves the at least one wager and any additional raise wager in favor of the dealer position; and if the dealer determines that a player position's two sub-games provide a same number of wins against the dealer, the dealer will resolve the at least one wager and any additional raise wager on the basis of an unused third card in the player position hand and the dealer position hand.

If the third card comparison results in a win for the player, the dealer resolves the at least one wager and any additional raise wager in favor of the player position based on the qualification of the dealer's hand;

If the third card comparison results in a win for the dealer, the dealer resolves the at least one wager and any additional raise wager in favor of the dealer position;

If the third card comparison results in a final tie between the player and dealer, the dealer resolves the at least one wager and any additional raise wager based on a predetermined rule selected from a group of possible resolutions.

DETAILED DESCRIPTION OF THE INVENTION

Figure 1:
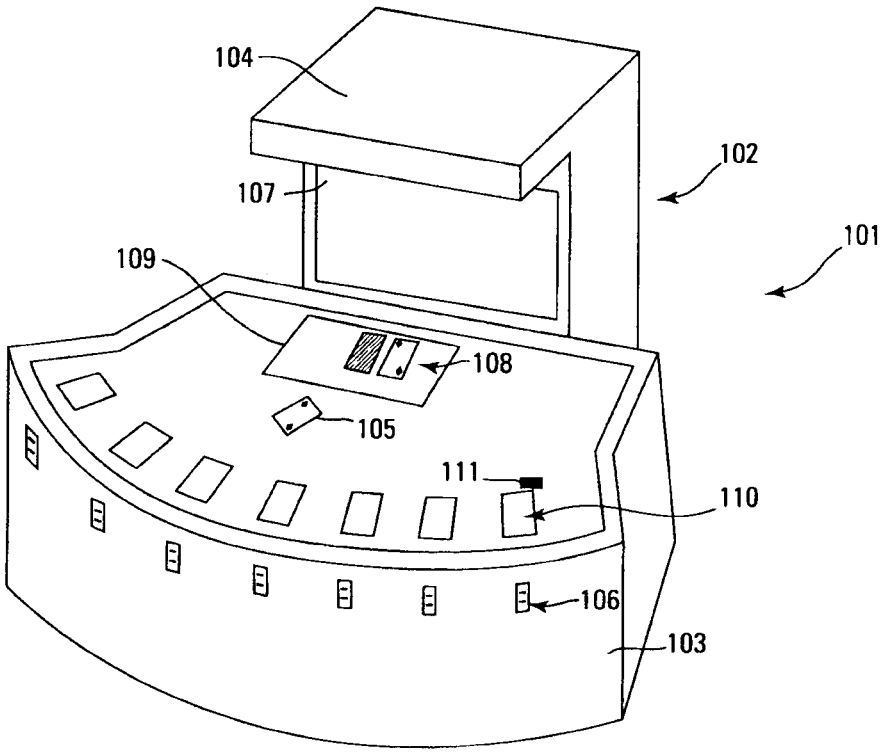
FIG. 1 shows an example of an automated table system useful in the practice of the present invention.
Figure 2:
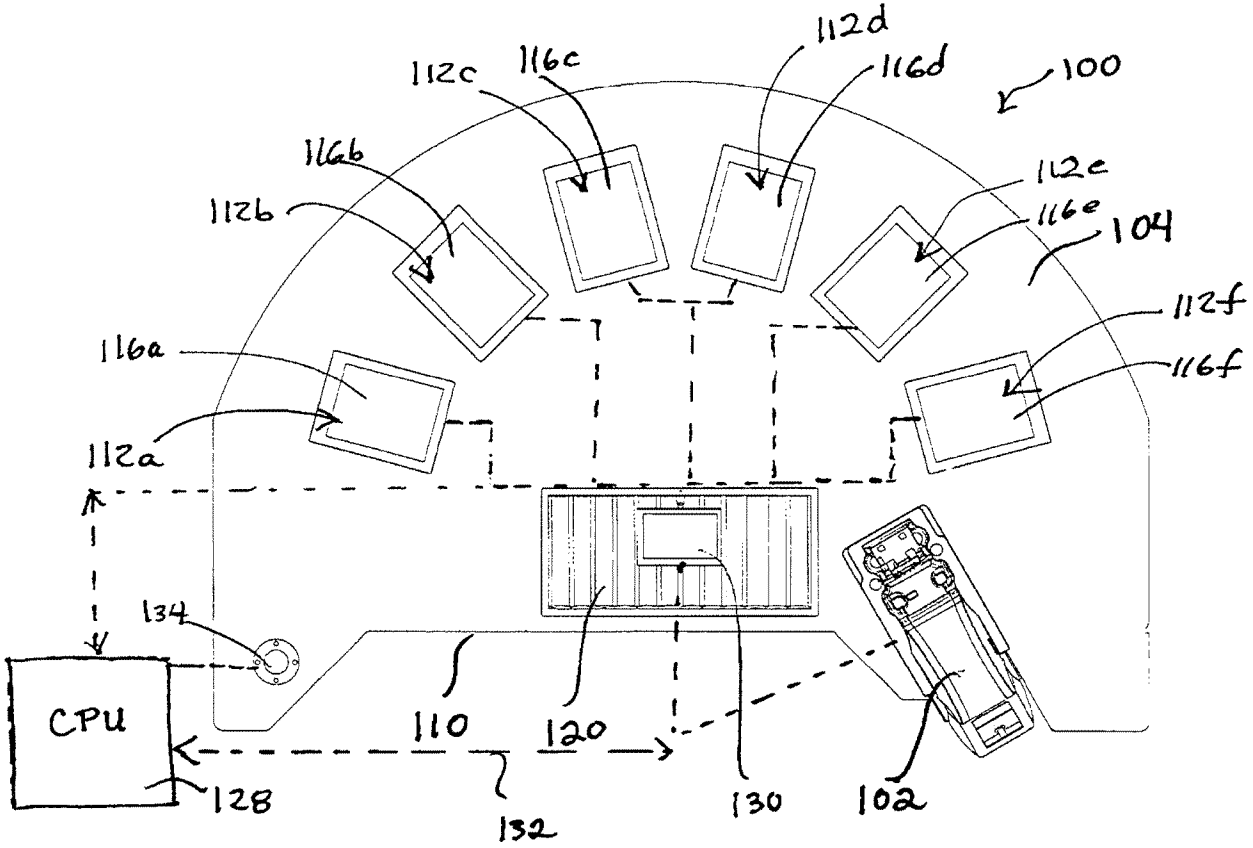
FIG. 2 shows an electronic/processor schematic for a MultiPlayer Platform (MPP) gaming system.

A method is used to play a wagering card game. At least some steps in the game may include:

a dealer providing a randomized set of playing cards; (The set may be a single deck of standard 52 playing cards, may be multiple decks of standard playing cards, and may include additional cards (wild cards, specialty cards, specialty decks with cards removed or added, etc.) The cards may be manually shuffled or electromechanically shuffled by a shuffler or card randomization machine)

the dealer accepting at least one wager at a player position on an underlying playing card game; (The wagers may be cash, coins, credits, tokens, chips or based on electronic accounting of player assets made at player terminals at player positions)

the dealer providing a first subset of exactly three playing cards to a player position; (The cards may be dealt in any order, one-at-a-time or three cards at a time and the like)

the dealer providing a second subset of exactly three playing cards to a dealer position; (The cards may be dealt in any order, one-at-a-time or three cards at a time and the like)

the dealer accepting continuation of the underlying playing card game at each player position having made the at least one wager by accepting an additional raise wager or receiving no raise wager at a player position;

the dealer then reveals all playing cards at the player positions and all cards at the dealer position and the dealer evaluates each player hand against the dealer hand as follows:

a) a player position hand having all three cards with a rank below a predetermined rank automatically loses; (This description of this outcome also includes a player notifying the dealer or the processor automatically determining the presence of all low cards)

b) a highest rank card from each player hand and the dealer hand play a game of war as a first sub-game, with the highest rank winning;

c) a second highest rank card from each player hand and the dealer hand play a game of war as a second sub-game, with the highest rank winning;

d) any ties void a sub-game;

if the dealer determines that a player position's two sub-games provide more wins against the dealer, the dealer resolves the at least one wager and any additional raise wager in favor of the player position based on the qualification of the dealer's hand;

if the dealer determines that a dealer position's two sub-games provide more wins against the player, the dealer resolves the at least one wager and any additional raise wager in favor of the dealer position; and if the dealer determines that a player position's two sub-games provide a same number of wins against the dealer, the dealer will resolve the at least one wager and any additional raise wager on the basis of an unused third card in the player position hand and the dealer position hand as follows:

e) the dealer position's third card or the player position's third card with a predetermined relative rank of either the highest rank or the lowest rank is declared a winner; (This basis of breaking ties is determined by house rules in advance of the start of the game. An absolute tie-breaker may be made by a rule that with a third-card tie, either the player or dealer position wins)

f) ties between the dealer position's third card and the player position's third card are determined by a preset rule of at least one result selected from the group consisting of a) the at least one bet and any additional raise bet are a push; b) the at least one bet and any additional raise bet are won at the player position; c) the at least one bet and any additional raise bet are won at the dealer position; e) the at least one bet is a push and any additional raise bet is won by the dealer position; f) the at least one bet is a push and any additional raise bet is won at the player position; g) the at least one bet is won at the dealer position and any additional raise bet is a push; and h) the at least one bet is won at the player position and any additional bet is a push.

This method may use physical playing cards wherein the randomization is effected by shuffling of the physical playing cards, as by manual shuffling or an electromechanical shuffler. The physical playing cards are preferably a single deck of physical playing cards and randomization is effected by automated electromechanical shuffling of the physical playing cards. The playing cards may be virtual playing cards and the method is performed on a system comprising a processor, a video display screen and player input controls and the processor displays hands at a virtual player position and a virtual dealer position and a random number generator provides random individual cards for the first subset of playing cards and the second subset of playing cards. The set of playing cards should comprise at least a standard deck of playing cards, fifty-two cards having four suits (spades, hearts, diamonds and clubs) having ranks from 2 to Ace. Multiple decks and/or specialty cards may also be included with the deck. The deck(s) must be randomized by shuffling to provide cards in a random order. The transformation of cards into a random order must be done before the play of each round of the game so that the cards provided cannot be predicted with any significant degree of certainty. The dealer controls the play of the game and dictates the rules of play of the game. The dealer will not allow cards to be dealt to player positions unless the appropriate wager is verified by the dealer. The dealer segments the shuffled set of playing cards into random content subsets of exactly the number of cards that the dealer must provide in each step of the method. The cards may be manually dealt or automatically dealt by a shuffling apparatus. The shuffling apparatus may be a batch shuffler or a continuous shuffler. Cards may be provided one at a time from a delivery position in the shuffler, entire randomized deck(s) may be provided from the shufflers, or individual hands of exactly three cards for delivery to individual player positions and the dealer position. There are a number of variations in the play of the game that may be used.

The shuffling may be performed by a number of various methods, including manual shuffling to produce a randomized set of playing cards. The automatic shufflers may operate by either actually shuffling a portion of or entire set of playing cards (e.g., one or more decks of playing cards), or by providing hands or subsets of playing cards randomly out of the original complete set of playing cards. The cards may be batch shuffled or continuously shuffled (returned, spent cards from previous hands are returned to the machine and randomly distributed among cards already in the machine). The shuffling mechanism may be accomplished by use of carousels (or linear moving stacked arrays) of multiple compartments into which cards are inserted (randomly or in predetermined locations among the compartments) and then unloaded from the compartments (randomly or in predetermined order of compartments) so that random hands or subsets of playing cards are distributed to a delivery area for distribution by the dealer. The cards may also be delivered to a delivery tray by random removal (e.g., random ejection as understood in the art, or random removal by any other technology) from the original set and delivery of the randomly withdrawn/removed cards to the delivery tray to form random hands or random subsets in the delivery tray.

The method of paying winning player position hands wherein the dealer position hand must qualify with a highest rank card of at least one predetermined rank selected from the group consisting of 2 through Ace such that if the dealer position hand does not qualify, any player position that did not automatically lose has one of the at least one wager and the additional raise wager resolved at the player position as 1:1 return and a respective other of the at least one wager and the additional raise wager is resolved as a push. The method is preferred where step e) is determined by the processor by a lowest rank of the third card.

All possible game resolutions are summarized here:

i) Player automatically loses the game if all 3 of his cards are below a predetermined rank; player loses his at least one wager;

ii) Player loses to the dealer on the first two sub-games; player loses his at least one wager and any additional raise wager;

iii) Player wins against the dealer on the first two sub-games and the dealer has a qualifying hand; player wins on his at least one wager and any additional raise wager;

iv) Player wins against the dealer on the first two sub-games and the dealer has a non-qualifying hand; player wins one of the at least one wager and any additional raise wager and will push on the respective other;

v) Player loses to the dealer on the third card comparison; player loses his at least one wager and any additional raise wager;

vi) Player wins against the dealer on the third card comparison and the dealer has a qualifying hand; player wins on his at least one wager and any additional raise wager;

vii) Player wins against the dealer on the third card comparison and the dealer has a non-qualifying hand; player wins one of the at least one wager and any additional raise wager and will push on the respective other;

viii) Player hand ties a qualifying dealer hand after the third card comparison; resolution of wagers is determined by a preset rule of at least one result selected from the group consisting of a) the at least one bet and any additional raise bet are a push; b) the at least one bet and any additional raise bet are won at the player position; c) the at least one bet and any additional raise bet are won at the dealer position; d) the at least one bet is a push and any additional raise bet is won by the dealer position; e) the at least one bet is a push and any additional raise bet is won at the player position; f) the at least one bet is won at the dealer position and any additional raise bet is a push; and g) the at least one bet is won at the player position and any additional raise bet is a push.

ix) Player hand ties a non-qualifying dealer hand after the third card comparison; resolution of wagers is determined by a preset rule of at least one result selected from the group consisting of a) the at least one bet and any additional raise bet are a push; b) the at least one bet and any additional raise bet are won at the player position; c) the at least one bet and any additional raise bet are won at the dealer position; d) the at least one bet is a push and any additional raise bet is won by the dealer position; e) the at least one bet is a push and any additional raise bet is won at the player position; f) the at least one bet is won at the dealer position and any additional raise bet is a push; and g) the at least one bet is won at the player position and any additional raise bet is a push.

The method may be practiced where the dealer accepts a side bet at a player position on occurrence of at least one event selected from the group consisting of i) all three cards at a single playing position having a rank of 10 or higher; ii) at least two cards being aces; iii) at least two cards being Kings; iv) at least two cards being Queens; v) at least two cards being Jacks; and vi) at least two cards being tens.

The method may be practiced where the dealer accepts a side bet at a player position on occurrence of at least one event selected from the group consisting of i) all three cards at a single playing position having a rank of 10 or higher; ii) at least two cards being aces; iii) at least two cards being Kings; iv) at least two cards being Queens; v) at least two cards being Jacks; and vi) at least two cards being tens, and the processor determines the outcome of this wager and credits wins and debits losses on the side bet to a player position.

At least one wild card may be used in determining an outcome on the side bet at a player position. The wild card may be added to the deck, or a particular rank (e.g., all 2's, all three's, etc.) or suited rank (e.g., all 2's of spades and/or clubs, all 3's of diamonds and/or hearts) may be used. In an electronic version of the game, at least one wild card may be used in determining an outcome on the side bet at a player position and the processor determines the outcome of this wager using any wild cards present at those positions and credits wins and debits losses on the side bet to a player position.

The method may be practiced wherein the dealer accepts a side bet at a player position on occurrence of at least one event selected from the group consisting of a 2-card poker rank against a paytable of the first subset of cards at a player position.

The method may be practiced wherein the dealer accepts a side bet at a player position on occurrence of at least one event selected from the group consisting of a 2-card poker rank against a paytable of the first subset of cards at a player position, and the processor determines the outcome of this wager and credits wins and debits losses on the side bet to a player position.

Games of the present invention may also be practiced on other gaming platforms, such as on an electronic gaming machine or EGM, on a multi-player EGM, on a chipless gaming table, which utilizes physical cards and simultaneously enables credit wagering.

One preferred construction of a Chipless Table has from three to eight players (Shown in FIG. 4 as six player positions) with five, six or seven Player betting positions **112*a*-112*f* (with independent monitors 116*a*-114*f*) being preferred, a Dealer console 130, a playing card reading shoe 102 (or card reading shuffler or overhead camera imaging system or table mounted card reader—not shown), a chip tray 120, cards (not shown), a generic felt 136 and a table computer 128 using the Aquarius Controller™ protocol (game controller, under the table manufactured by Progressive Games, Inc. of Las Vegas, Nev.), for example, connected through an I/O port 134. The dealer position is at 110. Communication lines are shown, including for example 132**.

The game information (which is preferable for multiple games) is configurable and will be set-up during the initial installation of the table and may be switched from game to game on-the-fly at each table. It is from the set-up that the Game information is selected so that the graphics on the Player Touch Screen **116*a*-116*g*. Dealer Console 118, Pit Display 134 and Table Display 132 provide the correct information regarding the game in play. It is the capability of changing individual types of game events (e.g., from blackjack to baccarat) at a table that enables, or even requires that the generic felt 136** is free of any permanent printing that identifies only a specific game at a table. There may be separate monitors (not shown) that enable display of games names, game rules and paytables for individual games, or under table back-lighting that may project such information display on the table.

Using the Pit Display 134, the game is selected by casino personnel and communicated to the table controller 128 via a touch screen control on the pit display 134. The table controller (and/or a central pit controller) sends out the appropriate graphics to each of the Player screens and table signs to begin game play.

An exemplary chipless table system is disclosed in co-pending U.S. application Ser. No. 12/218,583, filed Jul. 15, 2008 and Ser. No. 12/231,759, filed Sep. 5, 2008 which are herein incorporated by reference in the entireties.

In one form of the invention, the game is played according to a live gaming table format. Such a format typically includes a standard gaming table with a substantially horizontal gaming surface, and with a printed felt layout. Built into the table or positioned on the table is provided a card handling device, which in one example is an automatic card shuffling device with playing card recognition capacity. An example of a suitable device is disclosed in pending application Ser. No. 11/810,864, filed Jun. 6, 2007, the content which is incorporated by reference into entirety. The card handling device preferably is equipped with a processor that controls card handling functions, receives and stores card information from the card recognition components and also is programmed with "house way" hand setting instructions for the game. The shuffler reads each card in each set of cards. For example, when the shuffler is programmed to deliver a set of six cards to each player and the dealer, the identity of each card in each set is stored in the processor's memory. Each set of cards is delivered to each player and to the dealer. In other embodiments, the card handling device is a shoe, and in order to capture the identify of each card in the set, the dealer inputs a command to designate the first and last card dealt into the set of cards. This type of system is similar to and may be enabled according to the teachings of Published US Patent Application Document 20100090405 filed 1 Oct. 2009 (Roger Snow) which is incorporated herein by reference.

The processor preferably has memory and preconfigured hardware (e.g., FPGA or ASIC) content that may be accessed. In the memory may be stored a look-up table of possible arrangements of six or other number of cards into a high-hand, mid-hand and low-hand, and identifies how each hand should be set according to house way rules. One way to display the house way rules is to provide an electronic house way display on the gaming table, and to display the rank and/or suit of at least two of the three hands. Upon display, the dealer sets the hand according to the house way rules. The processor executes the code and/or software containing the rules of the game and the steps that must be executed in order.

Although the present invention has been described in terms of a live casino style game played with cards, chips and optionally an automatic card shuffler, it can be appreciated that the game may be offered in other formats, some well known, and other newer formats. Some non-limiting examples of other formats for offering games of the present invention include: live gaming tables that use physical cards and other game pieces and that enable credit wagering, electronic single player gaming machines, electronic multi-player gaming machines, hybrid gaming systems with physical game pieces and/or components for determining game outcome but that enable credit wagering such as the Rapid™ gaming systems distributed by Shuffle Master, Inc., games for practice play (i.e.—no monetary wagering) on cell phones, gaming stations, PC's, wireless gaming platforms, hand held game devices, parlor games, and the like and some emerging gaming opportunities including but not limited to internet gaming and gaming on systems designed specifically for use on aircrafts, etc.

Some alternate formats for performing game play method steps of the present invention are described in more detail below.

Computer-based Implementations

Methods of the present invention may be implemented in computer hardware, software, or computer hardware and software. A most common form of computer implementation is a stand-alone, single player electronic gaming machine with electronic player controls and one or more video output screens.

In computer-based embodiments, the gaming device preferably includes at least one processor, such as a microprocessor, a microcontroller-based platform, a suitable integrated circuit or one or more application-specific integrated circuits (ASIC's) or Field Programmable Gated Arrays (FPGA's). The processor is in communication with or operable to access or to exchange signals with at least one data storage or memory device, and/or a player monitor or monitors. In one embodiment, the processor and the memory device reside within the cabinet of a gaming device. Multiple gaming devices are typically connected to a casino information network.

The memory device stores program code and instructions, executable by the processor, to control the gaming device. The memory device also stores other data such as image data, event data, player input data, random or pseudo-random number generators, pay-table data or information, House Ways distributions and applicable game rules that relate to the play of the gaming device. In one embodiment, the memory device includes random access memory (RAM): which can include non-volatile RAM (NVRAM): magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device.

In other embodiments, part or all of the program code and/or operating data described above can be downloaded to the memory device through a suitable network. In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. The gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller" or "game controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In one embodiment, described in more detail below as a "chipless gaming platform", the gaming device includes one or more display devices that are mounted into a gaming table surface and are controlled by the processor in addition to or separately from the individual player monitors. The display devices are preferably connected to or mounted into the table structure. This may include a central display device which displays a primary game, dealer images, jackpot information, or information that is not specifically related to the game, such as sports information or winning events at other tables. This display device may also display any suitable secondary game associated with the primary game as well as information relating to the primary or secondary game (e.g., side bets, bonuses, jackpots and the like).

An alternative embodiment may include a central horizontal game display device and a vertically oriented virtual dealer display device as in Shuffle Master, Inc.'s Table Master® gaming system. The central display device may display the primary game, any suitable secondary game associated or not associated with the primary game and/or information relating to the primary or secondary game. These display devices may also serve as digital glass operable to advertise games or other aspects of the gaming establishment. The gaming device includes a credit display 20 which displays a player's current number of credits, cash, account balance, or the equivalent. In one embodiment, the gaming device includes a bet display displays a player's amount wagered. In one embodiment, as described in more detail below, the gaming device includes a player tracking display which displays information regarding a player's play tracking status.

In yet another embodiment, at least one display device may be a mobile display device, such as a PDA or tablet PC that enables play of at least a portion of the primary or secondary game at a location remote from the gaming device. The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism.

In one embodiment, as described in more detail below, the display device includes a touch-screen with an associated touch-screen controller. The display devices may be of any suitable size and configuration, such as a square, a rectangle or an elongated rectangle. The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, images of dealers and the like.

Other forms of the invention are in the form of game software that is implemented in a variety of formats, such as internet gaming, PC practice play, hand-held game devices, wireless gaming devices and the like.

Chipless Gaming Table Implementation

One enabling system useful in the practice of the present invention is a system marketed under the name i-TABLE® by Shuffle Master, Inc. of Las Vegas, Nev. That system includes: a) a physical gaming table; b) player monitors at each player position; c) a playing card reading and delivery system (e.g., commercially available shufflers and playing card delivery shoes with reading capability as sold under the Trade names of One2Six® shuffler, Ace® shuffler, I-DEAL® shuffler, I-SHOE® delivery shoe, etc.); d) a processor receiving information (numbers of cards, rank of cards, suits of cards, etc.) from the card reading and delivery systems; e) communication connectivity (hardwired or wireless) between necessary combinations of the card reading/delivery systems and the processor, the processor and the individual player monitors, and/or the card reading/delivery systems and the video monitors; and f) software in the processor that defines predetermined advantage for distributions of playing cards into multiple hands, game rules, hand history, and the like.

With regard to software f), it is understood in the practice of the present technology that this is not complex software that reads individual player hand cards and determines advantageous card distributions for a first time by extensive calculations. Rather, the entire range of possibilities of hands (e.g., all possible five card sets dealt to players in poker-style games) are known in poker style games.

Figure 4:
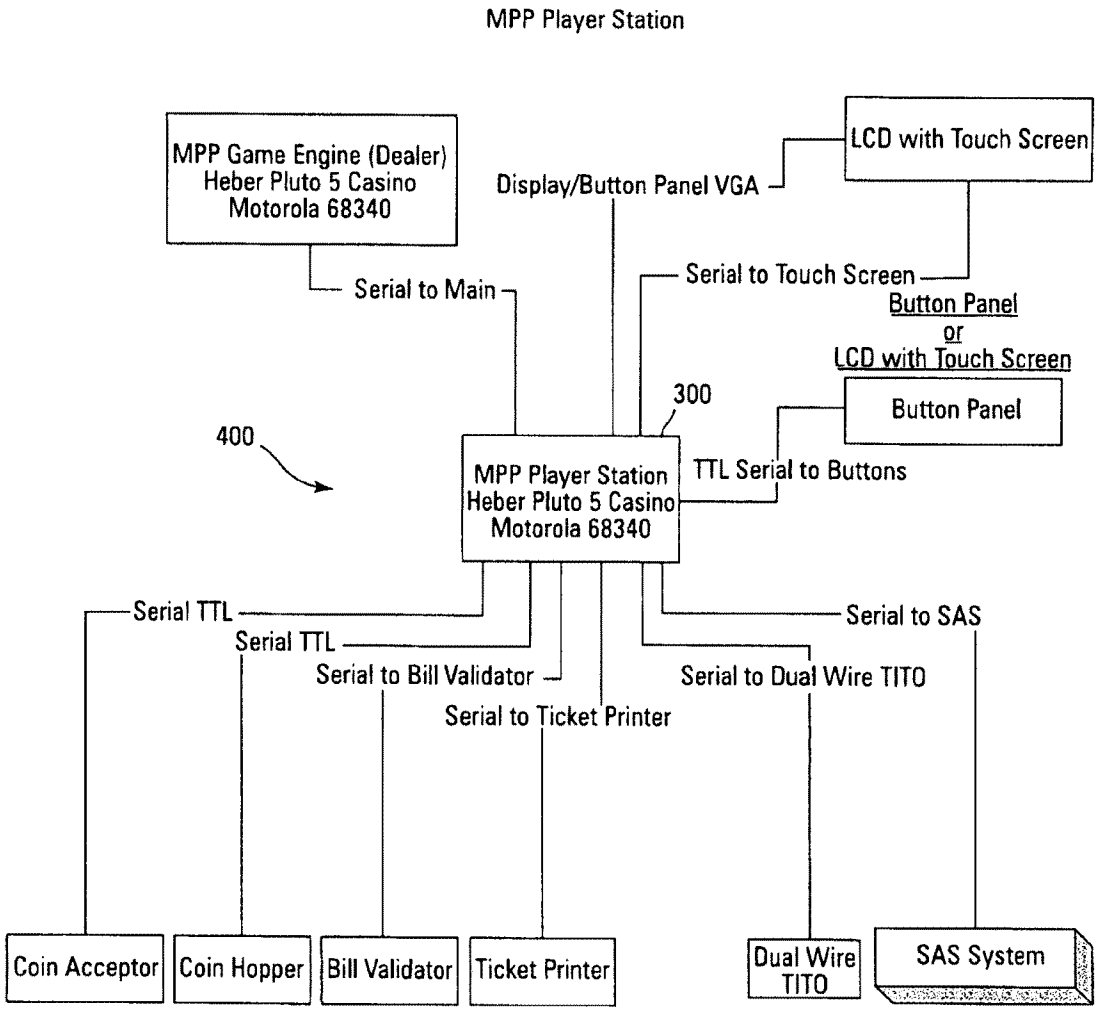
FIG. 4 shows an exemplary chipless gaming table system for playing live card games with physical playing cards dealt from an automatic card shuffler.

By way of non-limiting example, the following is directed to a live table game—electronic platform hybrid, marketed as SMI's I-TABLE®. FIG. 4 shows an exemplary chipless gaming table 100 system for playing live card games with physical playing cards dealt from an automatic card shuffler 102 according to technologies enabled and disclosed herein. Gaming table 100 can be a variety of common constructions or configurations as are typically used as the structural components of gaming table in the industry. The typical gaming table has a tabletop or playing surface 104 and a perimeter pad or armrest (not shown) which extends at least about the portion of the table periphery facing players. The relatively straight back portion of the periphery 110 is used by the dealer (not shown) and can be partly or wholly padded as may vary with the particular table chosen. Six player display/input systems **112*a*-112*f* are shown. Other numbers of systems can alternately be provided. Each of the player input systems 112*a*-112*f* has a processor (not shown) and a touch screen entry surface 116*a*-116*g*. The table includes a dealer chip tray 120**, even though players make credit wagers and not gaming chip wagers.

There is also a game controller, CPU or casino computer 128 whose location at the table system 110 is relatively unimportant, but which must be in direct (hardwired or wireless or networked) communication with each individual player processor 112*a*-114*f*, a card reading and/or delivery system 102, and a dealer input 130. The communication is represented graphically as broken lines 132 on the drawing. In a preferred form of the invention, the game controller 128 resides beneath the gaming table surface within a layer of the gaming table top structure. Layered gaming table tops enable the system to house all of the necessary electronics yet rest on a standard set of table legs and appear very similar to a standard gaming table to the untrained eye.

A preferable card handling device for administering a poker-style game is a hand-forming shuffler with integrated card recognition technology, from which playing cards are supplied, with a least a rank/count (and preferable also suit) of individual packs of cards are known before the cards are removed and delivered to player positions and/or the dealer position. The card delivery system 102 is in communication with the controller 128 by wired or wireless communication methods. Communication between the various system components is not limited to electronic or electrical signals, but may include optical signals, audio signals, magnetic transmission or the like.

An electronic player display (not shown) may be mounted on a pole and supported by pole support 134. The player display (not shown) may be a double-sided table sign. The side opposite the side viewable by the player is viewable by pit personnel. The player display is also in communication with game controller 128 and may provide information on the specific game being offered, historical player game results, game outcome trends, game rules, game play advice, advertisements and a variety of other information useful or entertaining for players.

Dealer display 130 includes data input capability and may be used by the dealer to input "buy in" amounts, to confirm game play results, to provide the dealer with game play instructions such as instructions on how to set the highest ranking hand, and the like. A random number generator may be included as part of the processing capability of the dealer display 130 and be used to determine which player receives a first hand, or for other purposes. In an alternate embodiment, the dealer display 130 resides on the card dispensing device 102 or as a separate keypad (not shown).

The individual player position processors (not shown) are preferable graphics processors and not full content CPUs as a cost saving, space saving, and efficiency benefit. With the reduced capacity in the processor as compared to a CPU, there is actually reduced likelihood of tampering and fraudulent input.

The betting chip rack 120 is provided to allow the dealer to conveniently store betting chips used by the dealer in cashing players in and out of the game. A money drop slot (not shown) is further included to allow the dealer to easily deposit paper money bills therein when players purchase credits.

An exemplary chipless table system is disclosed in co-pending U.S. application Ser. No. 12/218,583, filed Jul. 15, 2008 and U.S. application Ser. No. 12/231,759, filed Sep. 5, 2008 which are herein incorporated by reference in the entireties.

Multi Player Platform Implementation

FIG. 1 shows an example of an automated table system 101 useful to practice the game play methods of the present invention. This system is fully disclosed in U.S. Patent Publication 2005/0164759 A1. The content of this application is incorporated by reference in its entirety. The system 101 has an upright dealer display cabinet 102 with a top 104 and a virtual dealer viewing screen 107 which may be any form of display screen such as a CRT, plasma screen, liquid crystal screen, LED screen or the like. The common player area has a common player display screen 108 on which images of cards being dealt 105, 108, bets wagered (not shown) and touch screen player input controls 110 are located. Other player input functions may be provided on a panel 111 which might accept currency, coins, tokens, identification cards, player tracking cards, ticket in/ticket out acceptance, and the like.

Figure 3:
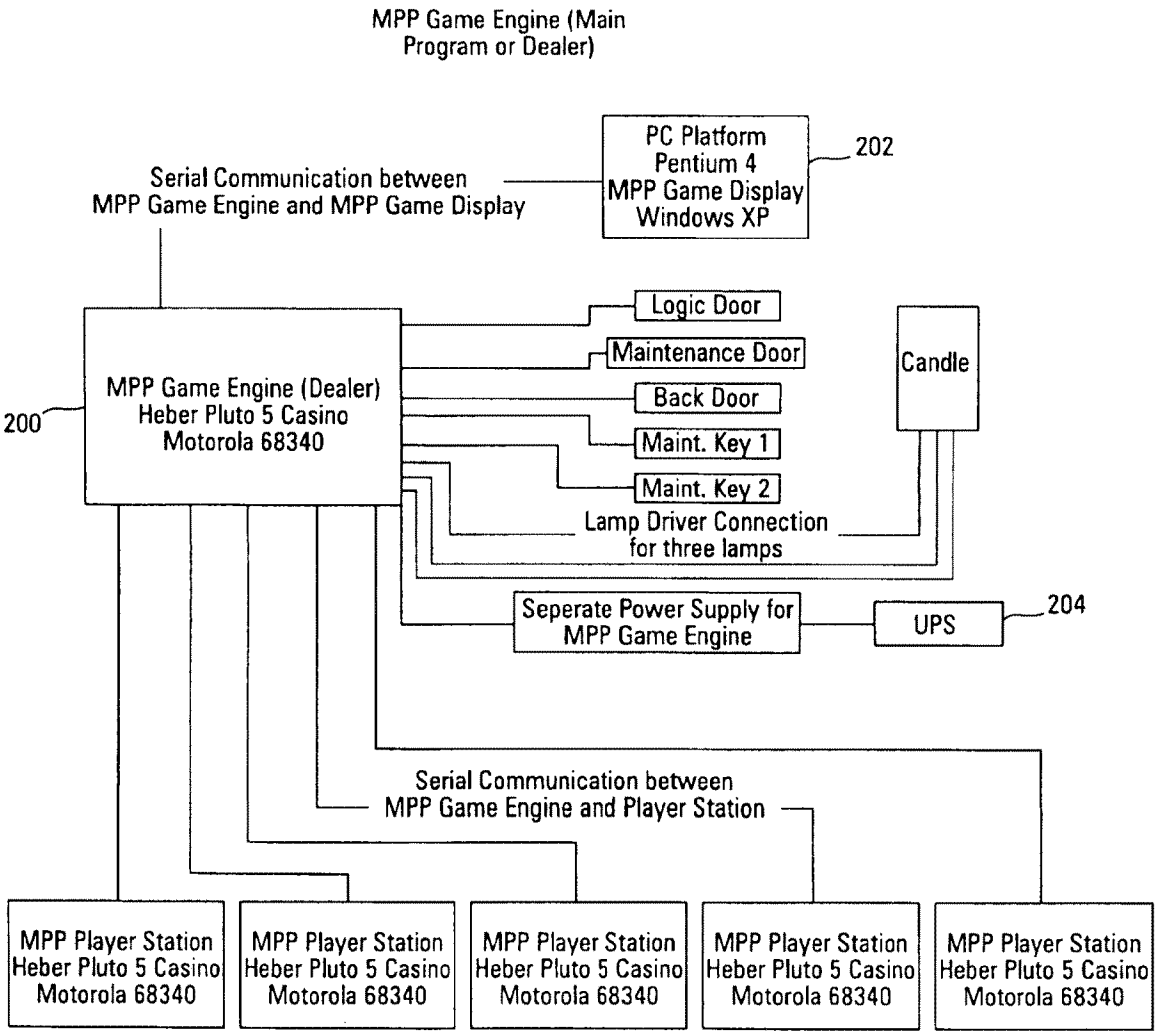
FIG. 3 shows the electronic/processing schematics of the MPP Player Station Intelligence board.

FIG. 3 shows an electronic/processor schematic for a MultiPlayer Platform (MPP) gaming system. The MPP Game engine (dealer) comprises a Heber Pluto 5 casino game board 200 (Motorola 68340 board) operating off the PC Platform Pentium™ 4 MPP Game Display processor 202. The game display processor operates on a Windows XP platform. The respective subcomponents on the Pentium 4 processor are labeled to show the apportionment of activity on the motherboard and the component parts added to the board. As is shown, the game engine has an Uninterruptible Power Supply 204. The game display processor directs activity on the Speakers, directs activities onto the MPP Game Service panel, and the Plasma Monitor Card Table display. It is important to note that all communications are direct from the game display processor, freeing up resources available to the game engine processor.

FIG. 4 shows the electronic/processing schematics of the MPP Player Station Intelligence board (Heber Pluto 5 Casino, Motorola 68340), each of which player stations (one for each player position) is in direct connection to the MPP Game Engine (Dealer), which is in turn directly connected to the PC Platform (not shown in this Figure). Each Intelligence board receives information for all player input systems specific to that player station, such as the shown Coin Acceptor, Coin Hopper, Bill Validator, Ticket Printer, Touch Screen and/or Display Button Panel, Dual Wire Ticket-in-Ticket-Out Printing and SAS System (SAS is one exemplary standard communications protocol used by a number of casinos central computer systems.) A significant benefit resides in the use of the independent Intelligence boards at each player position being in direct communication with the MPP Game Engine 300, as opposed to each individual player position button panel being dead or inactive until authorized by the main game processor, as previous automated gaming systems were constructed. In an electronic version of the game, without a physical dealer, the processor may act as the virtual dealer representing the house.

With the player intelligent boards, the main game PC can receive packets of information from each player station as events occur rather than having to poll each player position on a regular basis 100 times to gain the specific information for each player input that may be made.

The following is a discussion of exemplary hardware components that can be used in a multi-player gaming platform that enables play of games of the present invention.

Heber Board

A description of the Heber Board, (an exemplary board that can be used as a player station processor and/or game engine processor) a commercially available intelligent processing board is as follows. The Heber Board is known for its reliability and flexibility, especially for the Pluto 5 family of gaming products. The Pluto 5 is the controller of choice for the global gaming industry. Flexibility comes from a set of features built into the Pluto 5 (Casino) controller, and from the choice of optional add-on boards that can be used to adapt the Pluto family to best suit individual applications. In the area of interfacing, there are three distinct boards, each of which serves a particular function in helping the Pluto 5 to connect with the world outside:

RS485 Board

RS485 is an industrial-grade board for linking multiple systems in unforgiving circumstances for centralized information gathering. The Heber RS485 board is fully opto-isolated to provide complete circuit safety when used within 'electrically noisy' environments. The RS485 board uses a single RS232 connection to the Pluto 5 board and all necessary power is also derived through this link. Two header connectors may be provided for the RS485 channel to allow daisy chain connections between multiple systems.

HII/ccTalk Board

This board specializes in communicating with industry standard note/coin acceptors and payout hoppers. Equipped with dual communication channels, each port is configurable to use either the HII format to connect with Mars™ coin/note acceptors or the ccTalk format for Money Controls™ hoppers. Both channels are controlled via a single RS232 connection to the Pluto 5 board and all necessary power is also derived through this link. The Heber FastTrack™ package contains modular library functions for passing information via these channels.

Four Channel Relay Board

The relay board allows control of medium-level to high-level loads such as solenoids, without risk of damage or interference to the Pluto 5 circuitry. Four power-switching channels are available with absolute isolation from the Pluto 5 control signals. Each relay is capable of switching direct or alternating currents of up to 7 A at a maximum voltage of 250V.

Like the Pluto 5 board itself, its modular options have been used extensively so that their designs are fully developed and entirely stable. The options that are specified are consistently provided in mass quantities. As with all Pluto products, programming for the modular options is straightforward. This is enhanced with the use of the Pluto 5 Enhanced Development Kit and also the FastTrack™ package. Between them, these kits contain all of the low level and high level programming tools and library functions needed for gaming applications. These systems can be provided through a Pluto 5 Enhanced Development Kit datasheet 80-15353-7 (Heber Limited, Belvedere Mill, Chalford, Stroud, Gloucestershire, GL6 8NT, UK Tel: +44 (0) 1453 886000 Fax: +44 (0) 1453 885013 www.heber.co.uk. Specifications for the various boards are identified below.

RS485 Interface
Host Interface
RS232 connection to Pluto 5/Pluto 5 Casino
All power provided via RS232 link from host system
Communication Port
Dual four-way Molex 0.1" KK headers for daisy chaining purposes
Dimensions
80×61 mm (3.14.times.2.4")
Opto-isolated RS485 board
01-14536-2
HII/ccTalk Interface
Host Interface
RS232 connection to Pluto 5/Pluto 5 Casino
All power provided via RS232 link from host system
Communication Port
Single or dual 10 way header connectors
Dimensions
101.6×69.85 mm (4.times.2.8")
Part Number
Dual channel HII/ccTalk board
01-16171-2
Four Channel Relay Board
Host Interface
Connection to Pluto 5/Pluto 5 Casino via ribbon cable using four standard output lines
All power provided via ribbon cable link from host system
Switching Capabilities
Up to 250V AC or DC @ 7 A maximum per channel
Dimensions
80×61 mm (3.14.times.2.4")
Part Number
Four channel relay board
01-15275-1
80-16949-1

One proposed hardware configuration uses a "satellite" intelligent processor at each player position. The player station satellite processor is substantially the same as the primary game engine processor, a Heber Pluto 5 Casino board. The satellite processors receive instruction from the primary game engine but then handle the communications with player station peripherals independently. Each satellite processor communicates with only the peripherals at the same player station. Thus each player station has a dedicated satellite processor communicating with only the peripherals at the same player station and with the casino's central computer system. The peripherals are, but not limited to: Slot accounting Systems, Bill Validator, Ticket Printer, Coin Acceptor, Coin Hopper, Meters, Button panel or LCD touch screen and various doors and keys.

The satellite processors run proprietary software to enable functionality. The player station software is comprised of two modules, the first being an OS similar to the game engine Operating System and the second being station software that handles peripheral communications. The software may be installed on EPROMs for each satellite processor. The primary method of communication between the satellite processors and the primary game engine is via serial connectivity and the previously described protocol. In one example, information packets are prepared by the satellite processors and are sent to the game engine processor on the happening of an event.

The proposed game engine provides communication to the player stations to set the game state, activate buttons and receive button and meter information for each player station. Communication is via a serial connection to each of the stations. The new protocol for communication between the game engine, game display and player stations is an event driven packet-for-packet bi-directional protocol with Cyclic Redundancy Check (CRC) verification. This is distinguished from the Sega system that used continuous polling. This communication method frees up resources in the same engine processor because the processor no longer needs to poll the satellites continuously or periodically.

The new protocol uses embedded acknowledgement and sequence checking. The packet-for-packet protocol uses a Command Packet, Response Packet and a Synchronization Packet as illustrated below. The protocol uses standard ASCII characters to send data and a proprietary verification method.

Format of Command Packet
TABLE-US-00006 STX SEQ DATA LENGTH DATA CRC-16 ETX 1 1 3 3-999 5 1
Format of Response Packet
TABLE-US-00007 STX SEQ DSP PRV ETX 1 1 1 1 1

Format of Synchronization Response Packet

TABLE-US-00008 STX MTS MRS ETX 1 1 1 1

Legend for Figures

TABLE-US-00009 STX Start of Packet Character SEQ Sequence # (Cycles from '0' thru '9') LEN Length of Data Area ('003' thru '999') DATA ASCII Data Fields Separated with '|' Character CRC CRC-16 Value ('0000' thru '65535') Cyclic Redundancy Check ETX End of Packet Character DSP Disposition Code ('A' ACK, 'N' NAK, or 'I' Invalid Sequence) PRV Sequence Number of Last ACK'ed Packet (0 thru 9) MTS Main's Current Transmit Sequence Number MRS Main's Current Receive Sequence Number.

The Command Packet and Response Packet are used during primary game communications. The protocol uses redundant acknowledgement. For example: The packet is initially acknowledged when first received by the recipient. The same recipient will resend anther acknowledgement in the next communication. This second acknowledgement is the 'PRV' data in the response packet.

The communications between the Game Engine and the Player Station intelligence is preferably a transaction-based protocol. Either device can start a transaction, which is why it is essential that there be an intelligent board at each player position. All packets of information may be sent in any acceptable format, with ASCII format preferred as a matter of designer choice. All command packets usually contain a sequence number that is incremented after each successful packet exchange. The Game Engine and the Player Station intelligence use sequence numbers that are independent of each other. The sequence number keeps the communications in synchronization. This synchronization method is described later.

The command packet is used to send various commands such as Inputs, Lamps, Doors, Errors, Chirp, Game Results, player input, coin acceptance, player identification, credit acceptance, wagers, etc. The command packet format may be, by way of a non-limiting example: [0121] <STX><Sequence number><Data Length><Data><CRC-16><ETX>

The data format with in the command packet may be:

<Address><Command><Field 1>|<Field 2>|<Field n>|

The response packet format may be:

<STX><Sequence number><Disposition><Previous ACK><ETX>

The sync request packet format may be:

<SYN>

The sync response packet format may be:

<STX><Mains Current Transmission Sequence><Mains Current Receive Sequence><ETX>

A major strength of the protocol is its resilience of the Game Protocol and its ability to free up resources within the game engine. Those resources can in turn be used to provide more intricate games, and multi-media affects.

Synchronization Method:

The satellite and host must become synchronized in order to provide for reliable communications using packet numbers. To facilitate this, a novel protocol synchronization method that is used. Upon applying power to the satellite, or after a communications failure, the satellite automatically enters into synchronization mode. In the synchronization mode the satellite sends out the ASCII SYN (0x16) character about every second. It is expecting a special response packet containing transmit and receive packet sequence numbers to be used from that point on. After receiving the special response packet, the sequence numbers are used as-is, and not incremented until a successful packet exchange is completed. After communications is synchronized, the sequence numbers are incremented after each packet is successfully sent or received.

As was noted before, the main game processor may contain information, data, programming and other necessary functions to enable the play of multiple games off the same machine. For example, the main game engine may have rules and commands that will enable play of high and low games of the present invention and other card games. The system may be controlled so that different games may be played at different times on command of the casino or players.

The scope of the invention shown in the above examples and descriptions are intended to be only specific, non-limiting examples and descriptions of the generic concepts claimed herein.

The invention claimed is:

1. A method of playing a wagering card game on an electronic gaming system comprising a processor, player input controls and a video display, the method comprising:

the processor being configured to execute code accepting at least one wager at a player position on an underlying playing card game, the wager based on value obtained through at least one value input source in the electronic gaming system selected from the group consisting of a coin acceptor, bill validator and ticket-in-ticket-out printer;

upon recognition of the at least one wager, the processor providing a first subset of exactly three random virtual playing cards from a virtual set of playing cards to a video display visible at the player position where a wager has been accepted by the processor;

the processor providing a second subset of exactly three random virtual playing cards from the virtual set of playing cards to a video display visible at a virtual dealer position;

the processor accepting commands for continuation of the underlying playing card game at each player position having made the at least one wager by accepting an additional raise wager or receiving no raise wager at a player position;

the processor reveals at the video display visible at the player position all playing cards at the player positions and all cards at the dealer position and the processor evaluates each player hand against the virtual dealer hand as follows:

player position hand having all three cards with a rank below a predetermined rank automatically loses;

a highest rank card from each player hand and the virtual dealer hand play a game of war as a first sub-game, with the highest rank winning;

a second highest rank card from each player hand and the virtual dealer hand play a game of war as a second sub-game, with the highest rank winning;

any ties void a sub-game;

if the processor determines that a player position's two sub-games provide more wins against the virtual dealer virtual cards, the processor resolves the at least one wager and any additional raise wager in favor of the player position based on the qualification of the virtual dealer's hand;

if the processor determines that a dealer position's two sub-games provide more wins against the player, the processor resolves the at least one wager and any additional raise wager in favor of the virtual dealer position; and if the processor determines that a player position's two sub-games provide a same number of wins against the virtual dealer, the processor executes code that resolve resolves the at least one wager and any additional raise wager on the basis of an unused third card in the player position hand and the virtual dealer position hand as follows:

the processor executes code to determine when the virtual dealer position's third card or the player position's third card with a predetermined relative rank of either the highest rank or the lowest rank is declared a winner;

the processor executes code to determine when there are ties between the virtual dealer position's third card and the player position's third card are determined by a preset rule of at least one result selected from the group consisting of a) the at least one bet and any additional raise bet are a push; b) the at least one bet and any additional raise bet are won at the player position; c) the at least one bet and any additional raise bet are won at the virtual dealer position; e) the at least one bet is a push and any additional raise bet is won by the virtual dealer position; f) the at least one bet is a push and any additional raise bet is won at the player position; g) the at least one bet is won at the virtual dealer position and any additional raise bet is a push; and h) the at least one bet is won at the player position and any additional raise bet is a push.

2. The method of claim 1 wherein the playing cards are virtual playing cards and the method is performed on a system comprising a processor, a video display screen and player input controls and the processor displays hands at a virtual player position and a virtual dealer position and a random number generator provides random individual cards for the first subset of playing cards and the second subset of playing cards.

* * * * *